US007997579B2

(12) United States Patent
Furuyama

(10) Patent No.: US 7,997,579 B2
(45) Date of Patent: Aug. 16, 2011

(54) MEDIUM CONVEYING DEVICE AND IMAGE FORMING APPARATUS

(75) Inventor: Koji Furuyama, Fukushima (JP)

(73) Assignee: Oki Data Corporation, Tokyo (JP)

( * ) Notice: Subject to any disclaimer, the term of this patent is extended or adjusted under 35 U.S.C. 154(b) by 111 days.

(21) Appl. No.: 12/285,143

(22) Filed: Sep. 30, 2008

(65) Prior Publication Data

US 2009/0087238 A1 Apr. 2, 2009

(30) Foreign Application Priority Data

Oct. 1, 2007 (JP) ..... 2007-257405

(51) Int. Cl.
*B65H 5/00* (2006.01)

(52) U.S. Cl. ..... 271/264

(58) Field of Classification Search ..... 271/272–274, 271/314, 264

See application file for complete search history.

(56) References Cited

U.S. PATENT DOCUMENTS

| | | | | |
|---|---|---|---|---|
| 4,046,372 | A * | 9/1977 | Ebner | 271/273 |
| 4,279,413 | A * | 7/1981 | Siwik et al. | 271/274 |
| 4,358,103 | A * | 11/1982 | Koike et al. | 271/248 |
| 5,764,382 | A * | 6/1998 | Shiraishi | 358/496 |
| 5,825,513 | A * | 10/1998 | Hasegawa | 358/498 |
| 6,995,880 | B2 * | 2/2006 | Tohyama et al. | 358/496 |
| 2004/0218230 | A1 * | 11/2004 | Furihata | 358/474 |

FOREIGN PATENT DOCUMENTS

| | | |
|---|---|---|
| JP | 05-186085 | 7/1993 |
| JP | 09-327951 | 12/1997 |
| JP | 10-104960 | 4/1998 |
| JP | 2004-276254 | 10/2004 |

* cited by examiner

*Primary Examiner* — Stefanos Karmis
*Assistant Examiner* — Thomas A Morrison
(74) *Attorney, Agent, or Firm* — Rabin & Berdo, PC

(57) ABSTRACT

A medium conveying device includes a conveyance path that is used for conveying medium; a medium guide that is furnished on the conveyance path and has at least one swing supporting portion; and a supporting section that supports the swing supporting portion to swing along a separation direction separating from the conveyance path so as to make the swing supporting portion support the medium guide to swing.

25 Claims, 17 Drawing Sheets

MEDIUM CONVEYING DEVICE AND IMAGE FORMING APPARATUS

FIELD OF THE INVENTION

The invention relates to a medium conveying device which conveys medium and an image forming apparatus comprising such medium conveying device, and especially relates to a medium conveying device and an image forming apparatus which may convey medium of any thickness.

BACKGROUND OF THE INVENTION

In conventional image forming apparatus such as printer, copying apparatus and facsimile apparatus, a medium conveying device is furnished for conveying paper that serves as medium. The medium conveying device conveys paper conveyed from paper feed tray to an image forming section. When the image forming section formed an image on the conveyed paper, an ejecting section ejects the paper to an ejection use tray.

For example, in the following patent documentation 1, such technology is disclosed regarding a paper conveying device comprising a pair of guide member. In such paper conveying device, an upper guide member and a lower guide member are fixed in parallel on a side frame of image forming apparatus and form a conveyance path with a certain interval in the image forming apparatus. Further, a drive roller and an idle roller are respectively provided on the sides of lower and upper guide members. The two rollers are furnished oppositely and the paper supplied from the paper feed tray to between respective rollers is conveyed into a conveyance path by the rotation of the rollers.

Patent Document 1: Japanese Patent publication Hei 5-186085

SUMMARY OF THE INVENTION

A first aspect of the invention is to provide a medium conveying device. The medium conveying device comprises a conveyance path for conveying medium; a medium guide that is furnished on the conveyance path and has at least one swing supporting portion; and a supporting section which supports the swing supporting portion to swing along a separation direction separating from the conveyance path so as to make the swing supporting portion support the medium guide to swing.

A second aspect of the invention is to provide a medium conveying device. The medium conveying device comprises a conveyance path for conveying medium; and a medium guide that is furnished on the conveyance path and has at least one swing supporting portion, wherein, when the medium is conveyed from one end of the medium guide, the one end of the medium guide is pushed up; when the medium is conveyed to a predetermined position of the medium guide from the one end of the medium guide, other end of the medium guide is pushed up.

A third aspect of the invention is to provide an image forming apparatus. The image forming apparatus comprises a medium conveying device, wherein the medium conveying device includes a conveyance path for conveying medium; and a medium guide that is furnished on the conveyance path and has at least one swing supporting portion, wherein, when the medium is conveyed from one end of the medium guide, the one end of the medium guide is pushed up; when the medium is conveyed to a predetermined position of the medium guide from the one end of the medium guide, other end of the medium guide is pushed up.

EFFECT OF THE INVENTION

According to the medium conveying device of the invention, because a medium conveying guide is furnished to swing along a separation direction from the conveyance path, so the interval of the conveyance path can be changed according to the thickness of the medium. Thus, the medium of any thickness can be conveyed smoothly.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Embodiment 1

In the embodiment, an example is explained by applying the present invention to a paper conveying device that is installed inside the image forming apparatus (printer).

Figure 4:
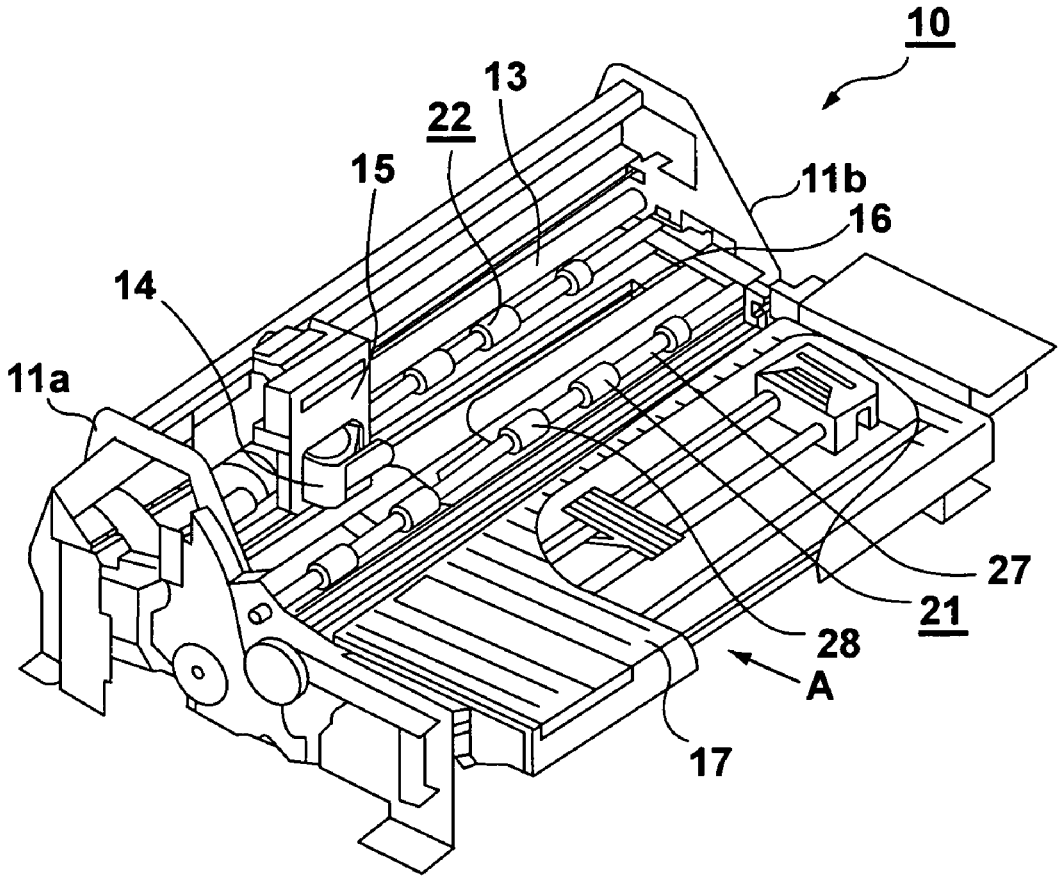
FIG. 4 is a cubic diagram showing a structure of a main part of a printer comprising a paper conveying device of the present invention.

FIG. 4 is a cubic diagram showing a structure of a main part of a printer comprising a paper conveying device of the present invention.

As shown in FIG. 4, in a printer 10, a carriage shaft 13 is furnished between side frames 11*a* and 11*b*, and a carriage 15 installed with a print head 14 can be moved along the carriage shaft 13.

A platen 16 is furnished under the carriage shaft 13 and extends parallel with the carriage shaft 13. The print head 14 is furnished to face to the platen 16. Between the print head 14 and the platen 16, a printing section is formed.

On the upstream side of the printing section along a paper conveyance direction, a table 17 is furnished as a paper feed tray, in which paper is set as medium. In order to convey the paper to the printing section, the printer 10 is equipped with a paper conveying device as a medium conveying device. A paper conveyance direction of the paper conveying device is shown by an arrow "A" in FIG. 4.

Figure 2:
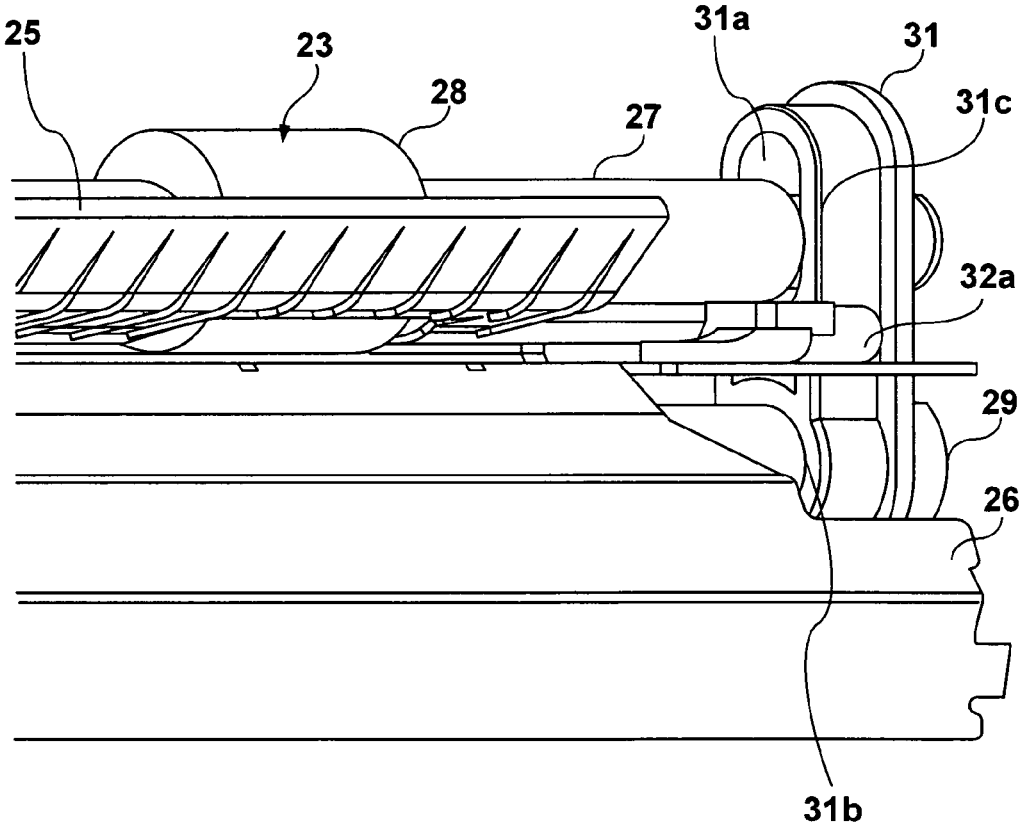
FIG. 2 is a cubic diagram showing a part of a structure of a paper conveying device in embodiment 1 of the present invention (I)
Figure 3:
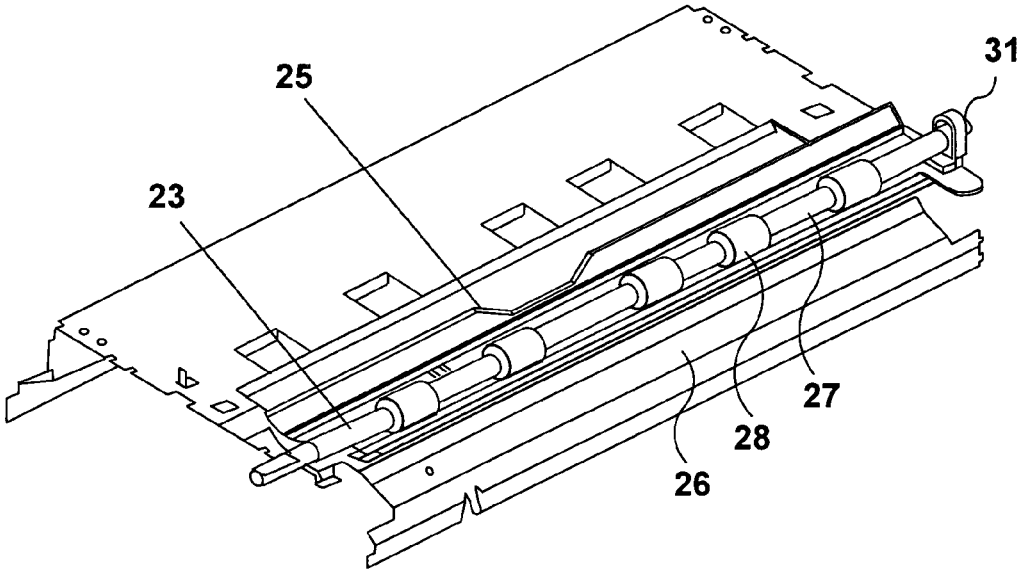
FIG. 3 is a cubic diagram showing a part of a structure of a paper conveying device in embodiment 1 of the present invention (II)

The paper conveying device comprises a front paper feeding roller unit 21 that is furnished on the upstream side of the printing section along the paper conveyance direction for conveying the paper on table 17 to the printing section; a rear paper feeding roller unit 22 that is furnished on the downstream side of the printing section along the paper conveyance direction for ejecting the paper that has been printed; and a sheet guide (not indicated in the Figure) that extends between the table 17 and the print head for guiding paper. The peripheral structure of the front paper feeding roller unit 21 of the paper conveying device is shown in FIG. 1, FIG. 2 and FIG. 3.

Figure 1:
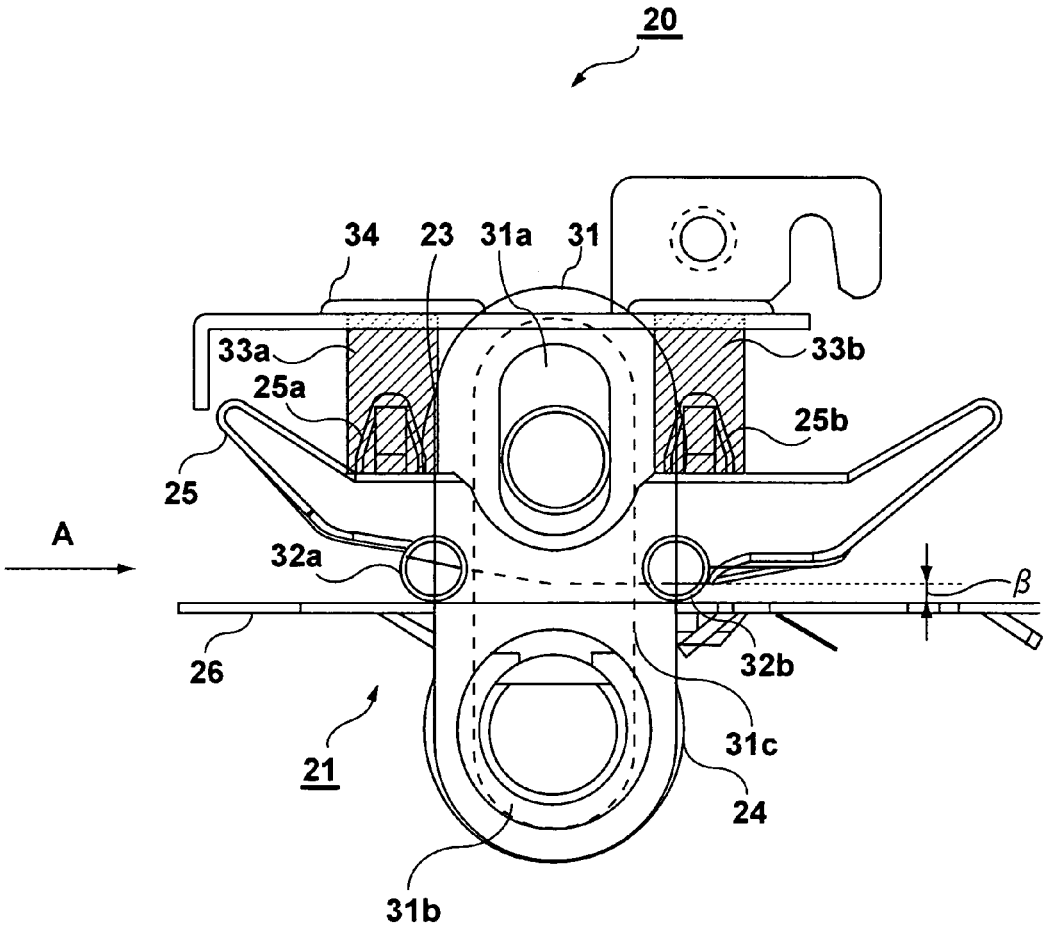
FIG. 1 is a side view showing a structure of a paper conveying device in embodiment 1 of the present invention.

FIG. 1 is a side view showing a structure of a paper conveying device in embodiment 1 of the present invention; FIG. 2 is a cubic diagram showing a part of a structure of a paper conveying device in embodiment 1 of the present invention (I); and FIG. 3 is a cubic diagram showing a part of a structure of a paper conveying device in embodiment 1 of the present invention (II).

As shown in FIG. 1, paper conveying device 20 of this embodiment has an upper paper feeding roller 23, a lower paper feeding roller 24, upper sheet guide 25 and lower sheet guide 26. The upper paper feeding roller 23 and the lower paper feeding roller 24 constitute a front paper feeding roller unit 21 (FIG. 1) and the upper sheet guide 25 and the lower sheet guide 26 constitute a sheet guide (i.e. sheet guide unit).

The lower sheet guide 26 is fixed on the both sides of the side frame 11*a* and 11*b* (FIG. 4) of the printer 10, as a conveyance path.

The upper sheet guide 25, as a medium guide, is furnished above the lower sheet guide 26 as swing, and form the sheet guide that serves as a paper conveyance path together with the lower sheet guide 26. A detail shape of the upper sheet guide 25 is shown in FIG. 7.

Figure 7:
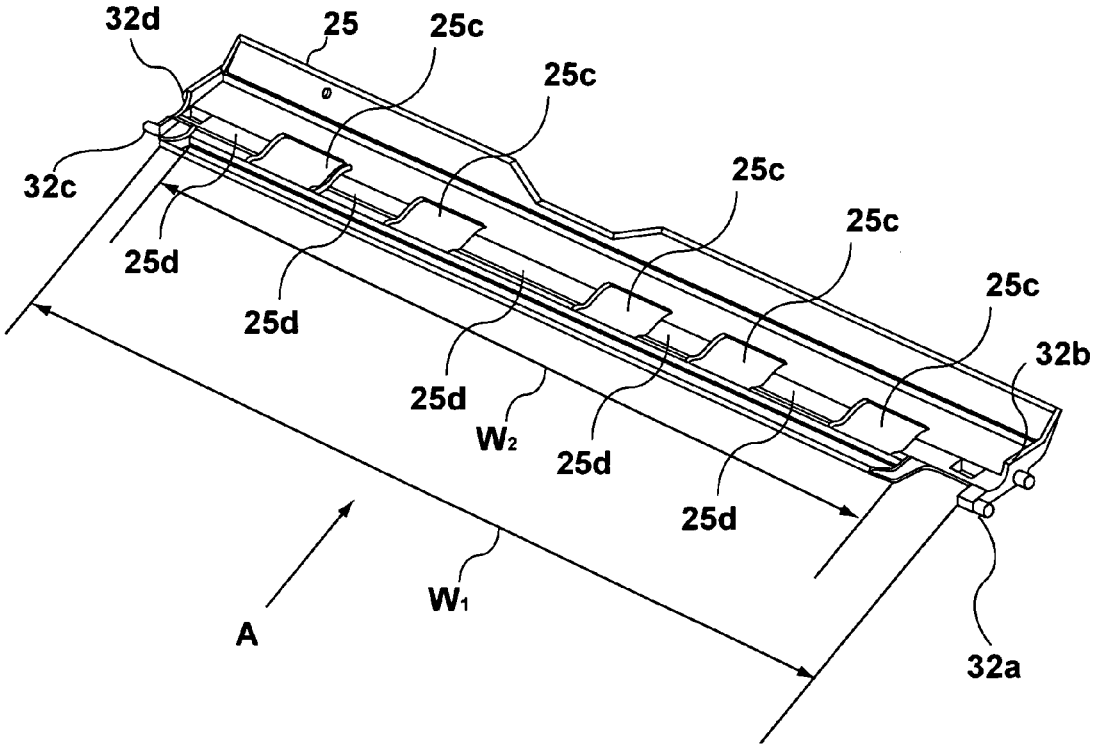
FIG. 7 is a cubic diagram showing a structure of an upper sheet guide of embodiment 1.

FIG. 7 is a cubic diagram showing a structure of an upper sheet guide of embodiment 1.

As shown in FIG. 7, the upper sheet guide 25 of this embodiment has 5 holes 25*c* and 6 grooves 25*d* to keep the paper feeding roller 23 to rotate freely above holes 25*c* and grooves 25*d*.

The upper sheet guide 25 has an asymmetric shape along the paper conveyance direction as shown by arrow "A" in FIG. 1 and FIG. 7. Further, as shown in FIG. 7, two pairs of swing supporting portions 32*a*, 32*b*, 32*c* and 32*d* are respectively furnished on the both outer sides of upper sheet guide 25. The swing supporting portions 32*a*~32*d* respectively have a cylinder shape, their outer parts contacts the lower sheet guide 26 to form a sheet guide with an interval greater than a predetermined interval β (FIG. 1) between the bottom of upper sheet guide 25 and the top of lower sheet guide 26. Here, on the basis of the asymmetric shape of the upper sheet guide 25, the interval between the upper sheet guide 25 and the lower sheet guide 26 is formed to be larger on paper feeding side (left side in FIG. 1) and to be smaller on paper ejecting side (right side in FIG. 1). Hereinafter, the minimum value β of the interval is represented as an interval value of the sheet guide. In order to avoid a waveform deformation and a big bend occurrence in paper while feeding thin paper, the interval value is desired to be set into lower value. In the paper conveying device 20 of this embodiment, the interval value of the sheet guide is set into 1 mm (β=1 mm).

Moreover, in the embodiment, the swing supporting portions 32*a*, 32*b*, 32*c* and 32*d* are used as an interval keeping member for keeping an interval in an interval value of β. However, it is possible to furnishing a protrusion portion to protrude toward the lower sheet guide 26 from the upper sheet guide 25, and to use the protrusion portion as an interval keeping member to keep an interval in an interval value of β.

As shown in FIG. 7, a distance between the swing supporting portions 32*a* and 32*b* and between the swing supporting portions 32*c* and 32*d* is $W_1$. A largest width of paper to be conveyed in the sheet guide is $W_2$. The swing supporting portions 32*a*~32*d* are placed on the outer side of the sheet guide, and $W_1>W_2$.

As shown in FIG. 7, with respect to hole 25*c* and grove 25*d*, the swing supporting portions 32*a* and 32*c* are placed on the upstream along the paper conveyance direction; and the swing supporting portions 32*b* and 32*d* are placed on the downstream along the paper conveyance direction. That is, as shown in FIG. 1, with respect to the upper paper feeding roller 23, the swing supporting portions 32*a* is placed on the upstream of paper conveyance direction, and the swing supporting portions 32*b* is placed on the downstream of paper conveyance direction.

The upper sheet guide 25 has two pairs of protrusions that are furnished on upper surface of the upper sheet guide 25 and are respectively placed on both sides. In FIG. 1, only the protrusions 25*a* and 25*b* on one side are shown.

Further, as shown in FIG. 1, on the upper sheet guide 25, springs 33*a* and 33*b* are furnished as pressing member to correspond to the protrusions 25*a* and 25*b*. The protrusion 25*a* is placed inside the spring 33*a* and is coupled with the spring 33*a*; one end of the spring 33*a* is fixed on the upper sheet guide 25. Likewise, the protrusion 25*b* is placed inside the spring 33*b* and is coupled with the spring 33*b*; one end of the spring 33*b* is fixed on the upper sheet guide 25.

Figure 5:
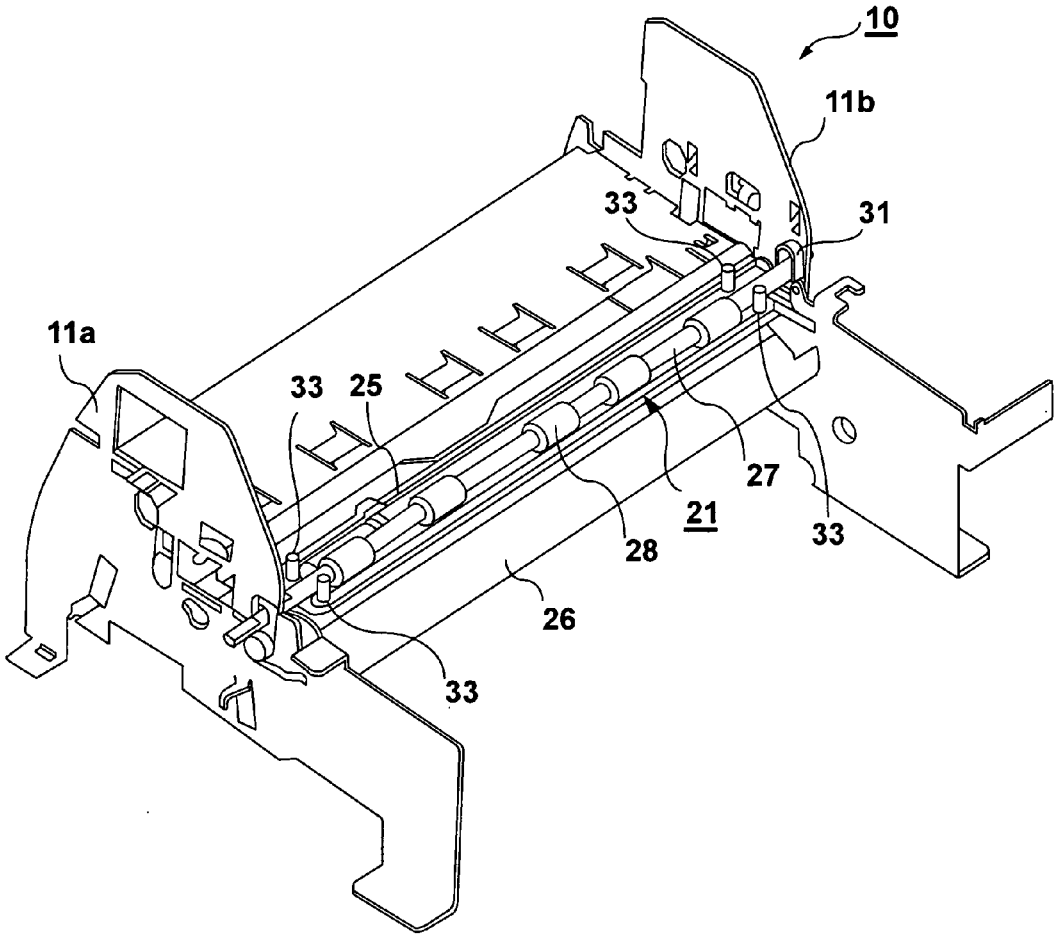
FIG. 5 is a cubic diagram showing a structure of a main part of a printer in embodiment 1 (I)

FIG. 5 is a cubic diagram showing a structure of a main part of a printer in embodiment 1 (I). In the figure, an upper sheet guide 25 and 4 springs 33 are shown.

As shown in FIG. 5, there are 4 springs 33 on the upper sheet guide 25. Each spring 33 is coupled with a protrusion on the upper sheet guide 25, and its lower end is fixed on the upper sheet guide 25.

Further, above upper sheet guide 25, a sheet guide bracket 34 is furnished on the side frames 11*a* and 11*b* of printer 10 by using screw. Then, as shown in FIG. 1, each spring 33 is kept in a state whose upper end is fixed on the sheet guide bracket 34 and whose length is compressed to be shorter than a natural length. In the state, the spring 33 supplies pressure to the upper sheet guide 25 along a direction from the sheet guide bracket 34 to the lower sheet guide 26, that is, supplies an elastic force to the upper sheet guide 25 along a direction from the sheet guide bracket 34 toward paper conveyance path. In this embodiment, the elastic force supplied to the upper sheet guide 25 by each spring 33 is 25 gf, and the total elastic force supplied to the upper sheet guide 25 by 4 springs 33 is up to 100 gf. Further, in this embodiment, the upper sheet guide 25 has a weight of 50 g, and can swing toward a separation direction separating from the lower sheet guide 26 together with resisting the elastic force supplied by 4 springs 33.

Figure 6:
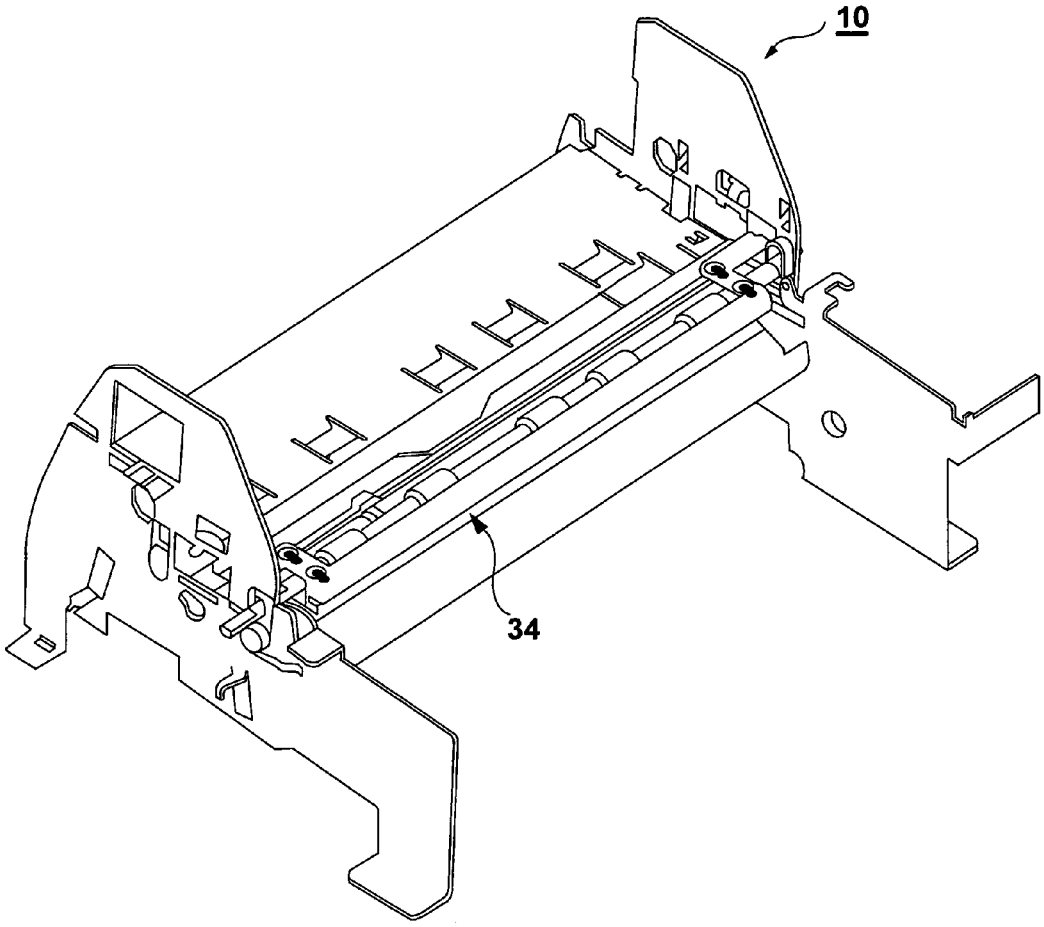
FIG. 6 is a cubic diagram showing a structure of a main part of a printer in embodiment 1 (II)

FIG. 6 is a cubic diagram showing a structure of a main part of a printer in embodiment 1 (II).

As shown in FIG. 6, a sheet guide bracket 34 supplies pressure to the upper sheet guide 25 via the 4 springs 33. The sheet guide bracket 34 is screwed on the side frames 11*a* and 11*b* of the printer 10.

As a feeding roller, the upper paper feeding roller 23 is furnished on the upside of the upper sheet guide 25. As shown in FIG. 3 and FIG. 4, the upper paper feeding roller 23 consists of a shaft 27 that serves as a rotation shaft member, and several roller parts 28 mounted on in shaft 27. In this embodiment, the upper paper feeding roller 23 has 5 roller parts 28 made from rubber.

As shown in FIG. 1 and FIG. 2, the lower paper feeding roller 24 is furnished on the underside of the lower sheet guide 26, and consists of a shaft 29 that serves as a rotation shaft member, and several roller parts mounted on the shaft 29. The lower paper feeding roller 24 has the same roller parts as the roller parts 28 of the upper paper feeding roller 23, each roller part faces to the roller part 28 of upper paper feeding roller 23. In this embodiment, the lower paper feeding roller 24 has 5 roller parts made from rubber.

As described above, the upper sheet guide 25 has 5 holes 25*c* and 6 grooves 25*d* (FIG. 7). The 5 roller parts 28 of the upper paper feeding roller 23 protrude from the underside of the upper sheet guide 25 toward the paper conveyance path, via holes 25*c* of the upper sheet guide 25. Likewise, the lower sheet guide 26 also has 5 holes, and 5 roller parts of the lower sheet guide 26 protrude from the upside of the lower sheet guide 26 toward the paper conveyance path via the holes of lower sheet guide 26. The respective roller parts of the lower paper feeding roller 24 protrudes toward paper conveyance path and contact with the roller parts 28 of the upper paper feeding roller 23.

On the both ends of the upper paper feeding roller 23 and the lower paper feeding roller 24, a guide bush 31 is furnished as a limiting member. As shown in FIG. 1, the guide bush 31 has a hole 31*a* and a hole 31*b* on the upper side and the lower side of the paper conveyance path; and is fitted to a groove of the side frame 11 of printer 10 so as to be fixed, as shown in FIG. 4 and FIG. 5.

As shown in FIG. 2 and FIG. 3, the shaft 27 of the upper paper feeding roller 23 is inserted into the hole 31*a* on the upper side of guide bush 31, as moving vertically and rotating freely. That is, the upper hole 31*a* has a oval shape. According to the shape of the hole 31*a*, the guide bush 31 disallows the upper paper feeding roller 23 to move along a paper conveyance direction, but only allows the upper paper feeding roller 23 to move along a contact/separation direction with respect to the paper conveyance path.

In the lower hole 31*b* of the guide bush 31, the shaft 29 of the lower paper feeding roller 29 is inserted as rotating freely. The hole 31*b* has a round shape. According to such shape of the hole 31*b*, the guide bush 31 disallows the lower paper feeding roller 24 to move along a paper conveyance direction or along a contact/separation direction with respect to the paper conveyance path.

As shown in FIG. 1 and FIG. 2, the protrusion 31*c* of the guide bush 31 on the side of upper sheet guide 25 is set between the swing supporting portions 32*a* and 32*b* of the upper sheet guide 25. As a supporting part, the protrusion 31*c* disallows the upper sheet guide 25 to move along a paper conveyance direction, but only allows the upper sheet guide 25 to move along a contact/separation direction with respect to the paper conveyance path.

Continuously, it is to explain operation of the paper conveying device 20 in this embodiment.

Here, an example is explained that the paper conveying device 20 conveys a sheet of paper with a predetermined thickness from table 17 to printing section.

Figure 8:
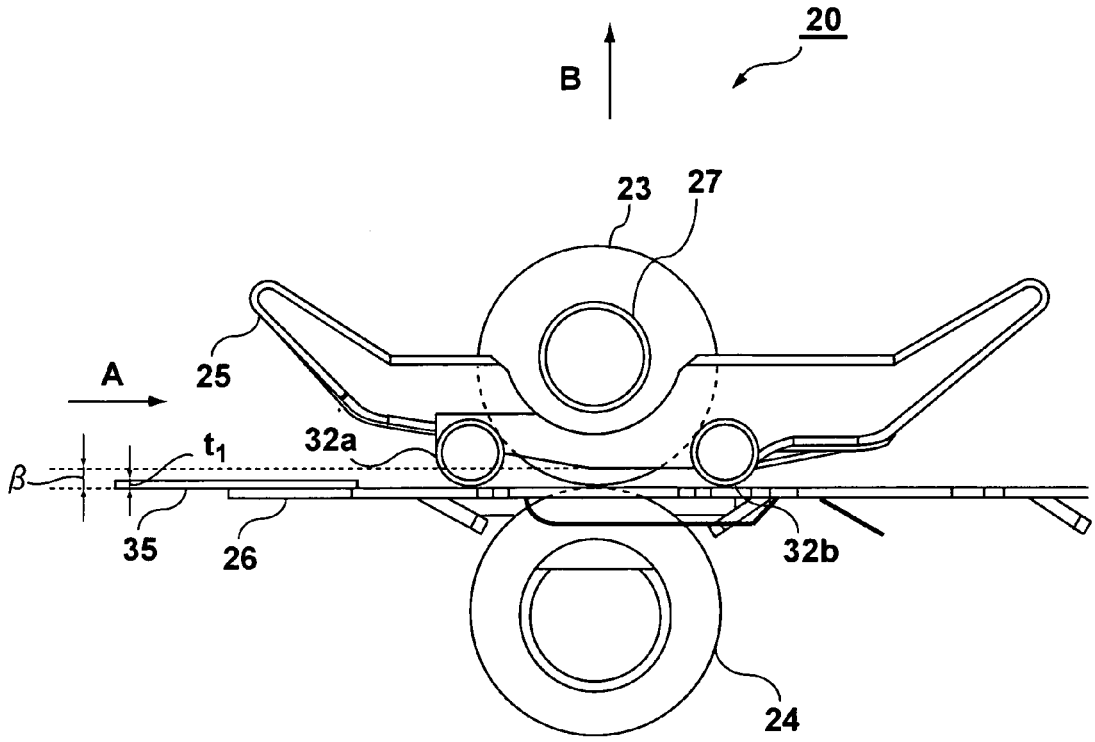
FIG. 8 is a side view for explaining paper conveyance operation of a paper conveying device in embodiment 1 of the invention (I)

First, the case to convey a sheet of paper with a thickness thinner than the interval value β of the sheet guide is explained on the basis of FIG. 8.

FIG. 8 is a side view for explaining paper conveyance operation of a paper conveying device in embodiment 1 of the invention (I).

In the paper conveying device 20, when the lower paper feeding roller 24 begins to rotate through its shaft 29 is driven by a driving section (not shown), with respective roller parts of the lower paper feeding roller 24 rotate, the upper paper feeding roller 23 including roller parts 28 is driven to rotate.

Paper 35 on table 17 (FIG. 4) is drawn in the direction shown by an arrow "A" in FIG. 8. The thickness of the paper 35 to be conveyed is represented as "$t_1$". Here, $t_1<\beta$. When the paper 35 is drawn into the sheet guide, the paper 35 does not contact with the upper sheet guide 25, the upper sheet guide 25 is still.

When a front edge of the paper 35 reached between the upper paper feeding roller 23 and the lower paper feeding roller 24, the shaft 27 of the upper paper feeding roller 23 is pushed up along a direction shown by an arrow "B" in FIG. 8 only by the thickness $t_1$ of the paper 35. At that time, a separation state between the paper 35 and the upper sheet guide 25 is kept, so that a still state of the upper sheet guide 25 is kept, and the interval value β of the sheet guide is kept.

The paper 35 is sandwiched and held between roller parts 28 and roller parts of lower paper feeding roller 24, and is conveyed along the direction of arrow "A", with the rotation of the lower paper feeding roller 24. When a rear edge of the paper passed through between the upper paper feeding roller 23 and the lower paper feeding roller 24, the shaft 27 of upper paper feeding roller 23 drops and returns to its original position.

Subsequently, the lower paper feeding roller 24 is stopped to rotate. Thereby, the upper paper feeding roller 23 also stops rotating, a paper conveyance process in the paper conveying device 20 is ended.

As described above, when the paper 35 whose thickness is thinner than the interval value β of the sheet guide is conveyed from the table 17 to the printing section, the upper sheet guide 25 is kept still without swinging.

Next, it is to explain an example that the paper conveying device 20 conveys a sheet of paper which is thicker than the interval value B of sheet guide on the basis of FIG. 9 to FIG. 12.

Figure 9:
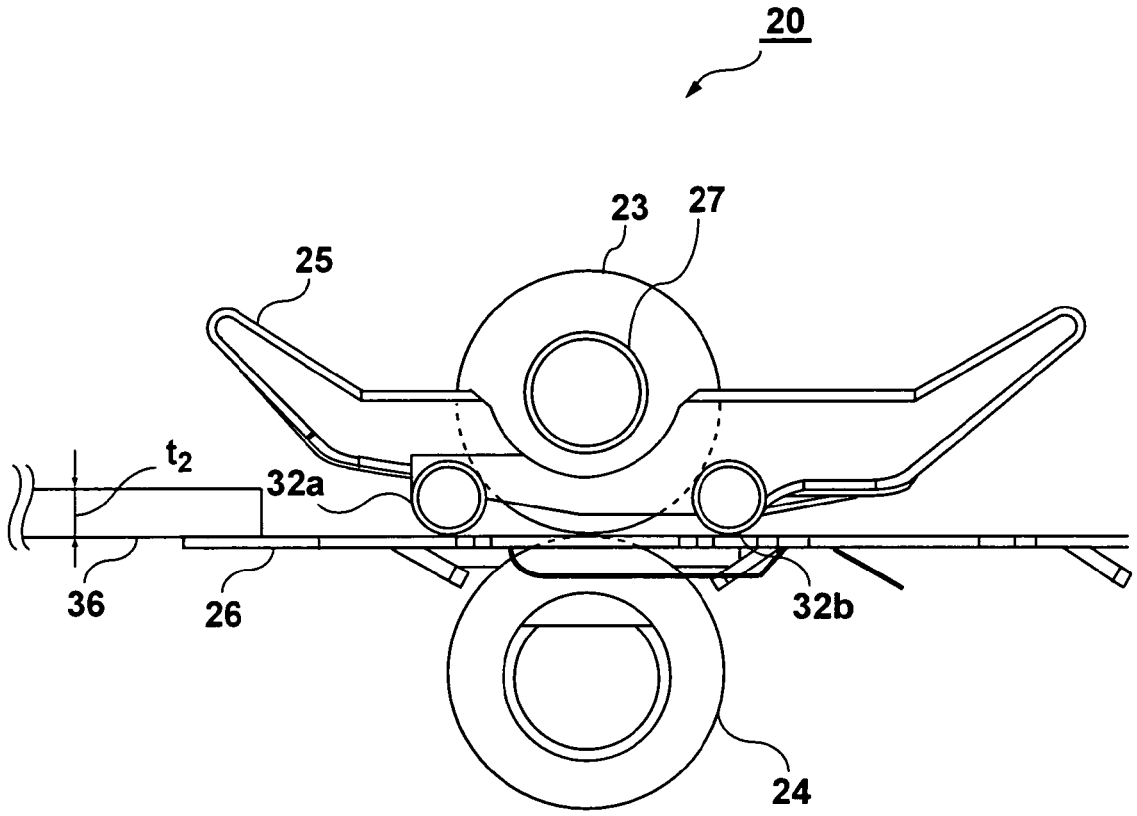
FIG. 9 is a side view for explaining paper conveyance operation of a paper conveying device in embodiment 1 of the invention (II)
Figure 10:
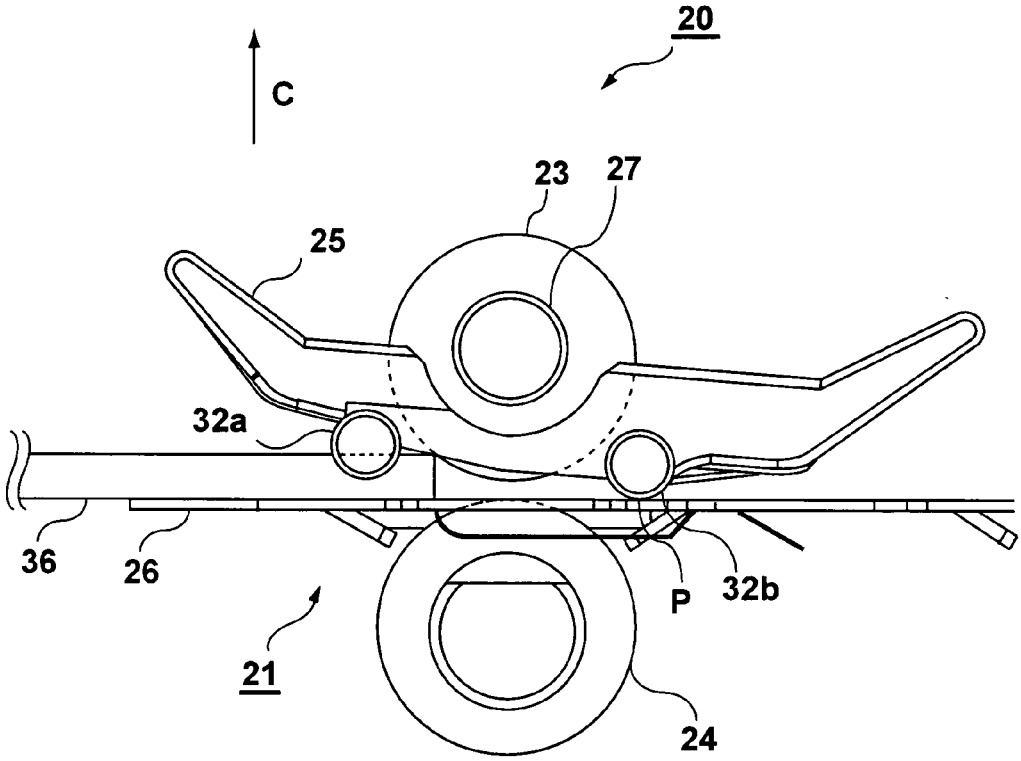
FIG. 10 is a side view for explaining paper conveyance operation of a paper conveying device in embodiment 1 of the invention (III)
Figure 11:
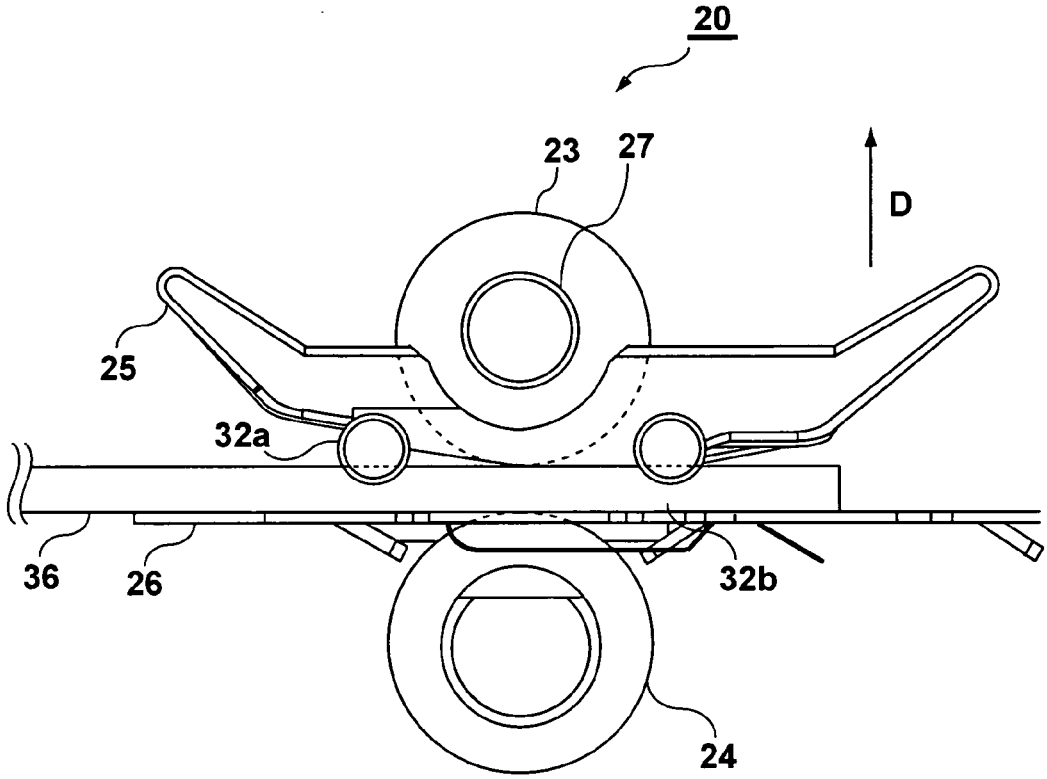
FIG. 11 is a side view for explaining paper conveyance operation of a paper conveying device in embodiment 1 of the invention (IV)
Figure 12:
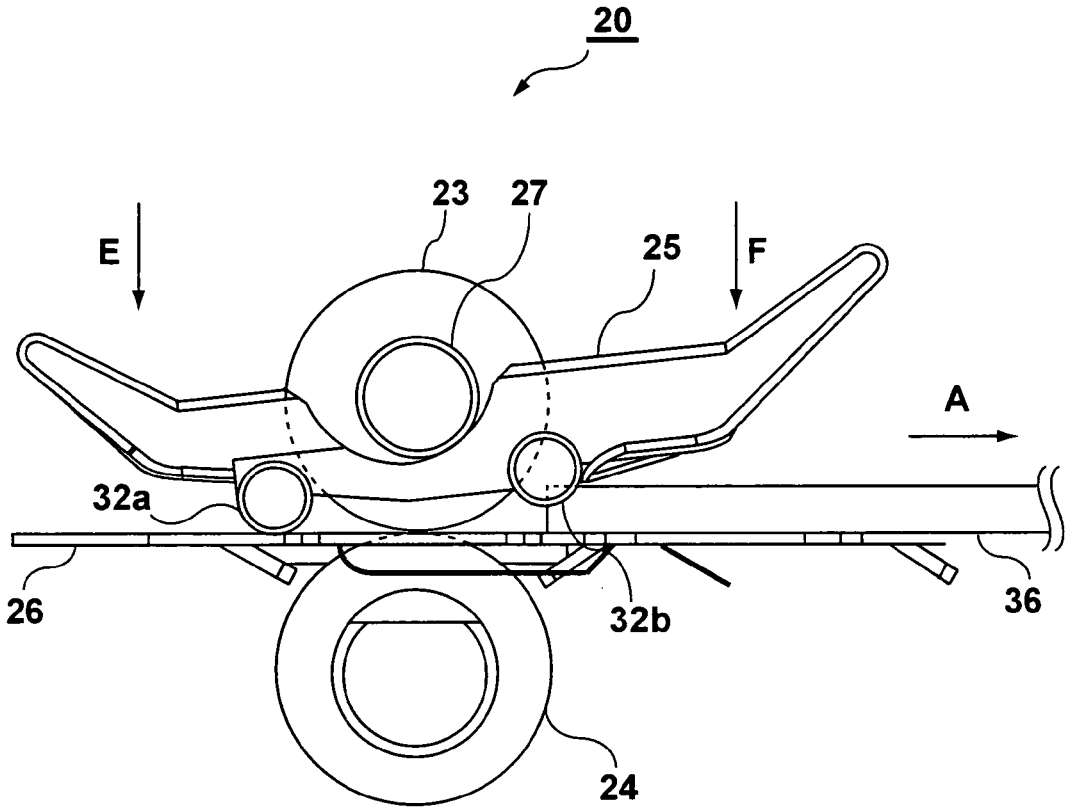
FIG. 12 is a side view for explaining paper conveyance operation of a paper conveying device in embodiment 1 of the invention (V)

FIG. 9 is a side view for explaining paper conveyance operation of a paper conveying device in embodiment 1 of the invention (II); FIG. 10 is a side view for explaining paper conveyance operation of a paper conveying device in embodiment 1 of the invention (III); FIG. 11 is a side view for explaining paper conveyance operation of a paper conveying device in embodiment 1 of the invention (IV); and FIG. 12 is a side view for explaining paper conveyance operation of a paper conveying device in embodiment 1 of the invention (V).

Because operations from that the lower paper feeding roller 24 begins to rotate to that the paper 36 (FIG. 9) whose thickness $t_2 \geqq \beta$ is drawn into between the upper sheet guide 25 and the lower sheet guide 26 are the same as that in the case to convey the paper 35 whose thickness $t_1 < \beta$, so their detail explanation is omitted.

In the sheet guide, the interval between the upper sheet guide 25 and the lower sheet guide is larger at the drawing side and is smaller at the ejecting side; the front edge of paper 36 enters into the bottom of upper sheet guide 25 in the position where the interval equals to the thickness $t_2$ of the paper 36.

Subsequently, the upper sheet guide 25 is pushed up by the front edge of paper 36, and swings along a direction of an arrow "C" meanwhile resisting the elastic force of the spring 33 and the weight of the upper sheet guide 25. That is, the upper sheet guide 25 regards a contacting part P of the swing supporting portion 32*b* and the lower sheet guide 26 as a fulcrum to rotate and swing clockwise; and the supporting portion 32*b* separates from the lower sheet guide 26. Therefore, the interval between the upper sheet guide 25 and the lower sheet guide 26 increases on the paper drawing side (FIG. 10).

With the rotation of the lower paper feeding roller 24, when the paper 36 is continuously conveyed, the swing supporting portion 32*b* separates from the lower sheet guide 26 according to the thickness of paper 36. That is, the upper sheet guide 25 rotates to swing oscillates anticlockwise along a direction of an arrow D, i.e. a separation direction separating from lower sheet guide 26, meanwhile resisting the elastic force of spring 33 and the weight of upper sheet guide 25, until the interval value of the sheet guide equals to the thickness $t_2$ of the paper 36 (FIG. 11).

The paper 36 is sandwiched and held between the roller parts 28 and the roller parts of the lower paper feeding roller 24, and is continuously conveyed with the rotation of the lower paper feeding roller 24. When the rear edge of the paper 36 passed through between the upper paper feeding roller 23 and the lower paper feeding roller 24, the shaft 27 of the upper paper feeding roller 23 drops. Further, with the elastic force of the spring 33 and the weight of the upper sheet guide 25, the upper sheet guide 25 swings in a direction of an arrow "E", and the swing supporting portion 32*a* contacts with the lower sheet guide 26 (FIG. 12).

Subsequently, while continuously conveying the paper 36, the upper sheet guide 25 swings in a direction of an arrow "F", and the swing supporting portion 32*b* contacts with the lower sheet guide 26. And then, the lower paper feeding roller 24 is stopped rotating, and a paper conveyance process in the paper conveying device 20 ends.

As described above, when the paper 36 which is thicker than the interval value β of the sheet guide, the upper sheet guide 25 swings meanwhile resisting the elastic force of spring 33 and, therefore, forms a sheet guide having an interval that corresponds to the thickness of the paper 36.

Further, through forming an interval between the upper sheet guide 25 and the lower sheet guide 26 and making the interval become bigger on the paper drawing side and become smaller on the paper ejecting side, the paper 36 is guided to between the upper sheet guide 25 and the lower sheet guide 26 and can be smoothly drawn.

Furthermore, in the case that the conveyance direction of the paper is reverse, the same effect also can be obtained.

As described above, when the paper conveying device 20 of this embodiment conveys the paper 36 which is thicker than the interval value of the sheet guide, the upper sheet guide 25 swings according to the thickness of paper in order to increase the interval of the sheet guide. Therefore, it is possible to convey paper of any thickness. Further, on the basis of the elastic force supplied to the upper sheet guide 25 by the spring 33 and the weight of the upper sheet guide 25, a pressure acts on the paper 36 that is conveyed in the sheet guide along a direction from the upper sheet guide 25 to the lower sheet guide 26. Therefore, it is possible to prevent paper 36 from occurring deformation while being conveyed and it is possible to maintain a precision of line change of the printing section. Moreover, on the basis of the shape of the upper sheet guide 25, the sheet guide has such interval which becomes bigger on the paper drawing side and becomes smaller on the paper ejecting side. Therefore, the paper 36 can be smoothly drawn to the sheet guide. Furthermore, in the upper sheet guide 25, the swing supporting portion 32 is furnished in plural places along the paper conveyance direction. Therefore, when printing paper 36 on its back plane so the conveyance direction becomes reverse, it is possible to form a sheet guide with proper interval.

Embodiment 2

Figure 13:
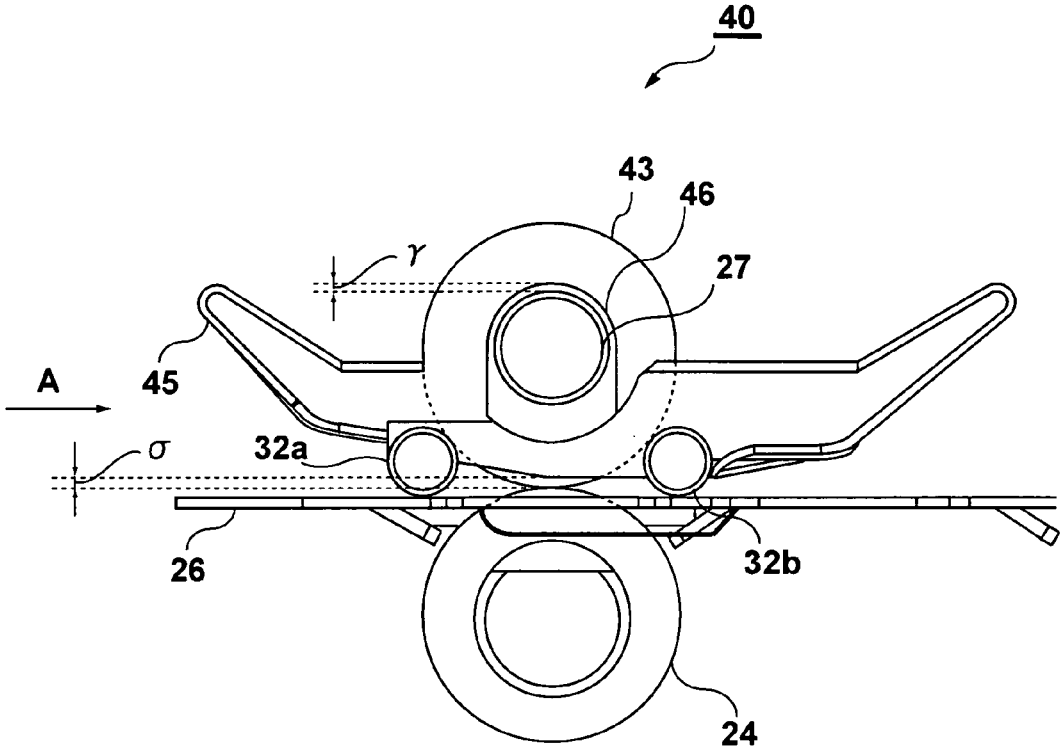
FIG. 13 is a side view showing a structure of a paper conveying device in embodiment 2 of the present invention.

FIG. 13 is a side view showing a structure of a paper conveying device in embodiment 2 of the present invention.

In a paper conveying device 40 of this embodiment, a structure that a stopper member 46 is furnished on an upper sheet guide 45 is different from that of embodiment 1.

Moreover, in this embodiment, the same structures as embodiment 1 are assigned the same symbol and their detailed explanations are omitted.

As shown by FIG. 13, the paper conveying device 40 of this embodiment has an upper paper feeding roller 43, a lower paper feeding roller 24, an upper sheet guide 25 and a lower sheet guide 26.

The upper sheet guide 45, as a medium guide, is furnished above the lower sheet guide 26 as swing, and form the sheet guide that serves as a paper conveyance path together with the lower sheet guide 26. A detail shape of the upper sheet guide 45 is shown in FIG. 14.

Figure 14:
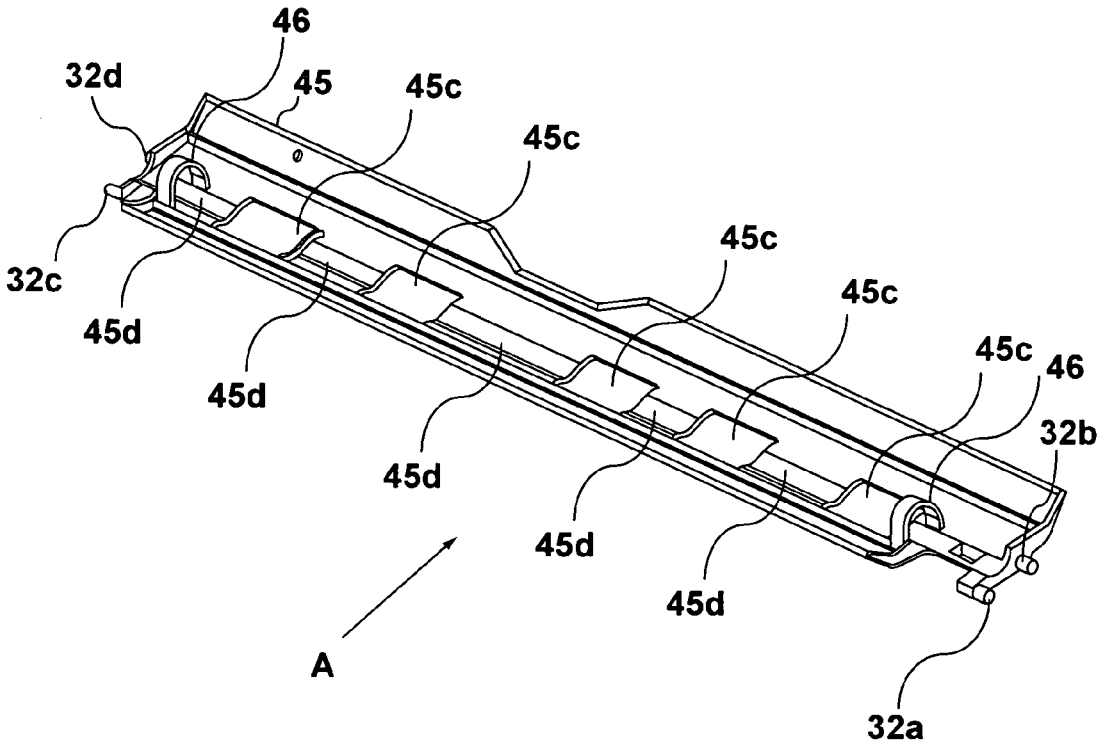
FIG. 14 is a cubic diagram showing a structure of an upper sheet guide of embodiment 2.

FIG. 14 is a cubic diagram showing a structure of an upper sheet guide of embodiment 2.

As shown by FIG. 14, the upper sheet guide 45 has 5 holes 25*c* and 6 grooves 45*d*, and also has an asymmetric shape along the paper conveyance direction as shown by arrow "A" in FIG. 13 and FIG. 14. Further, as shown by FIG. 14, two pairs of swing supporting portions 32*a*, 32*b*, 32*c* and 32*d* are respectively furnished on the both outer sides of upper sheet guide 45. Furthermore, two pairs of protrusions (not shown) are furnished on upper surface of the upper sheet guide 45 as well as embodiment 1 (FIG. 1), the upper sheet guide 45 is supplied with an elastic force along a direction from the sheet guide bracket 34 toward the lower sheet guide 26 by spring 33 serving as pressing member.

Further, as shown by FIG. 14, on the both sides of the upper sheet guide 45 of this embodiment, the stopper member 46 is furnished as a contacting portion. The upper paper feeding roller 43 held on the upper sheet guide 45 is coupled together the stopper member 46, the upper sheet guide 45 is limited to move by an amount that is a predetermined amount or over along a separate direction separating from the upper feeding roller 43.

Figure 15:
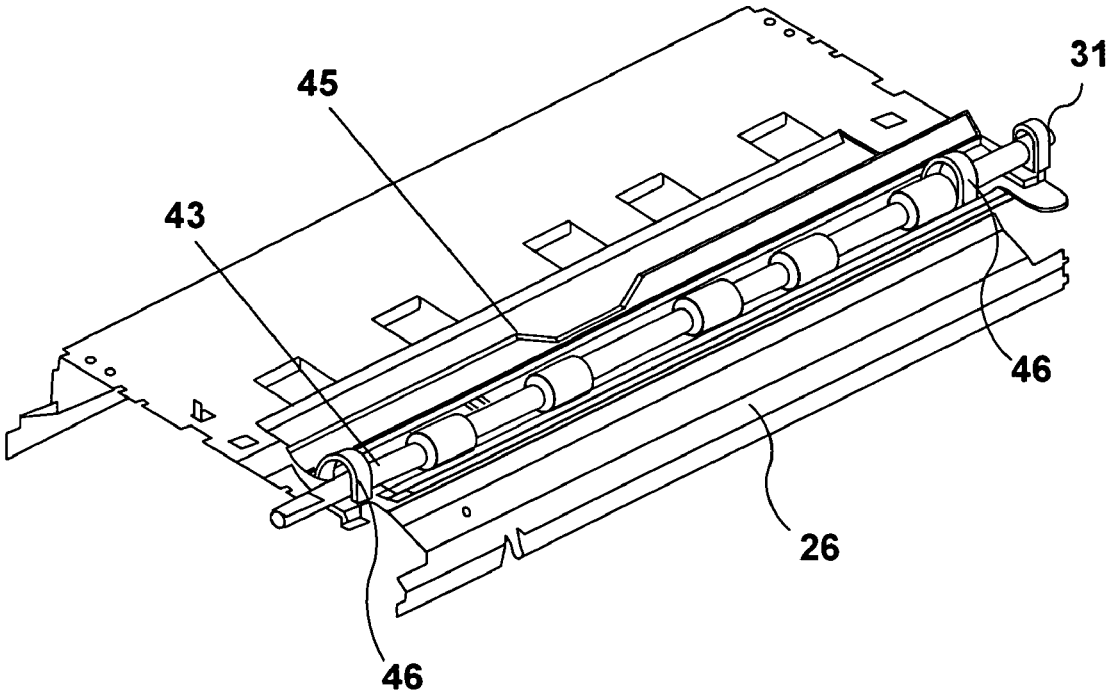
FIG. 15 is a cubic diagram showing a part of a structure of a paper conveying device in embodiment 2 of the present invention (II)

FIG. 15 is a cubic diagram showing a part of a structure of a paper conveying device in embodiment 2 of the present invention (II).

The upper feeding roller 43, as well as embodiment 1, has a shaft 27 and 5 roller parts 28. The shaft 27 of the upper paper feeding roller 43 is inserted in the stopper member 46 of the upper sheet guide 45. Here, as shown by FIG. 13, the stopper member 46 does not contact with the upper part of the shaft 27 and there is clearance whose length is "γ".

Each roller parts 28 of the upper paper feeding roller 43 protrudes from the underside of the upper sheet guide 45 toward the paper conveyance path, via holes 45*c* of the upper sheet guide 25. At that time, as shown by FIG. 13, a protrusion amount of the upper paper feeding roller 43 from the upper sheet guide 45 is "σ". Here, the protrusion amount "σ" represents a distance of vertical direction between the bottom position of the upper sheet guide 45 and the bottom position of the roller parts 28 of the upper paper feeding roller 43, when the upper sheet guide 45 is located in a position where the interval between the upper sheet guide 45 and the lower sheet guide 26 is minimum.

In the paper conveying device 40, the stopper member 46 is formed so that the protrusion amount "σ" becomes greater than the clearance "γ" between the stopper member 46 and the upper paper feeding roller 43, that is, $\sigma>\gamma$. In the paper conveying device 40 of this embodiment, "σ" is set to 0.5 mm and "γ" is set to 0.3 mm.

Next, regarding an operation of the paper conveying device 40 in this embodiment is explained as below.

Figure 16:
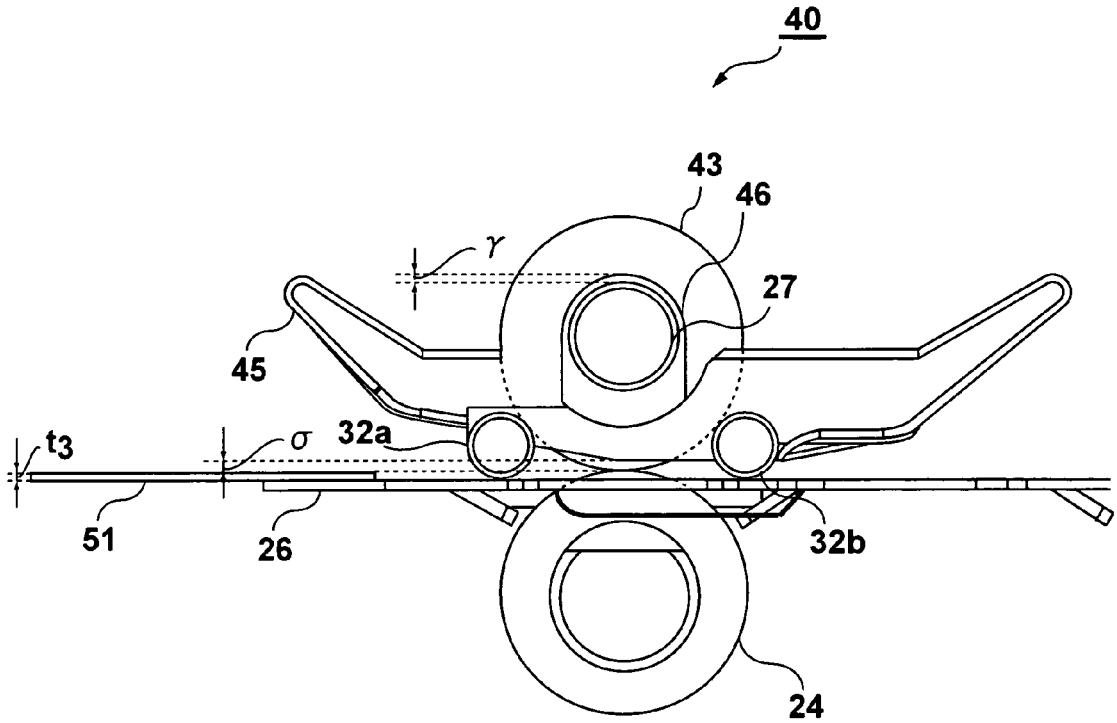
FIG. 16 is a side view for explaining paper conveyance operation of a paper conveying device in embodiment 2 of the invention (I)

First, regarding the case that a paper whose thickness is thinner than the clearance "γ" between the stopper member 46 and the upper paper feeding 43 is conveyed, it is explained through using FIG. 16.

FIG. 16 is a side view for explaining paper conveyance operation of a paper conveying device in embodiment 2 of the invention (I).

In the paper conveying device 40, the operations from that the lower paper feeding roller 24 begins to rotate to that a paper 51 (FIG. 16) whose thickness $t_3<\gamma$ is drawn to between the upper sheet guide 45 and the lower sheet guide 26 are the same as that of the paper conveying device 20 of embodiment 1, therefore, their detailed explanations are omitted.

When the front edge of the paper 51 reaches between the upper paper feeding roller 43 and the lower paper feeding roller 24, the shaft 27 of the upper paper feeding roller 43 is pushed up only by the thickness $t_3$ of the paper 51. Together with the pushing up operation, the clearance "γ'" between the shaft 27 and the stopper member 46 is reduced to $\gamma'=\gamma-t_3$, however, in which, $\gamma'>0$, according to a condition of $t_3<\gamma$. That is, the upper part of the shaft 27 does not contact with the stopper member 46, and the stopper member 46 is kept in still state.

Further, with the shaft 27 is pushed up, the protrusion amount "σ'" of the upper paper feeding roller 43 from the upper sheet guide 45 becomes $\sigma-t_3$ ($\sigma'=\sigma-t_3$). Here, because $t_3<\gamma<\sigma$, so $\sigma'>0$. That is, the roller parts 28 of the upper paper feeding roller 43 protrudes from the bottom of the upper sheet guide 45 toward the lower sheet guide 26.

The protrusion amount "σ'" corresponds to the nearest distance between the surface of the conveyed paper 51 and the bottom of the upper sheet guide 45. That is, $\sigma'>0$ means that the paper 51 separates from the upper sheet guide 45. Therefore, the paper 51 whose thickness is $t_3<\gamma$ is conveyed into sheet guide without contacting with the bottom of the upper sheet guide 45.

The paper 51 is conveyed together with the rotation of the lower paper feeding roller 24. When the rear end of the paper 51 passes between the upper paper feeding roller 43 and the lower paper feeding roller 24, the shaft 27 drops, then, returns to its original position.

Then, the driving rotation of the lower paper feeding roller is stopped and the paper conveyance process in the paper conveying device 40 ends.

As mentioned above, while conveying the paper 51 whose thickness is thinner than the clearance "γ" between the upper paper feeding roller 43 and the stopper member 46, the shaft 27 does not contact with the stopper member 46 and the upper sheet guide 45 is kept in a state before paper conveyance. At that time, the protrusion amount of the upper paper feeding roller 43 is kept in 0 or over, therefore, the paper 51 is conveyed into sheet guide without contacting with the bottom of the upper sheet guide 45.

Figure 17:
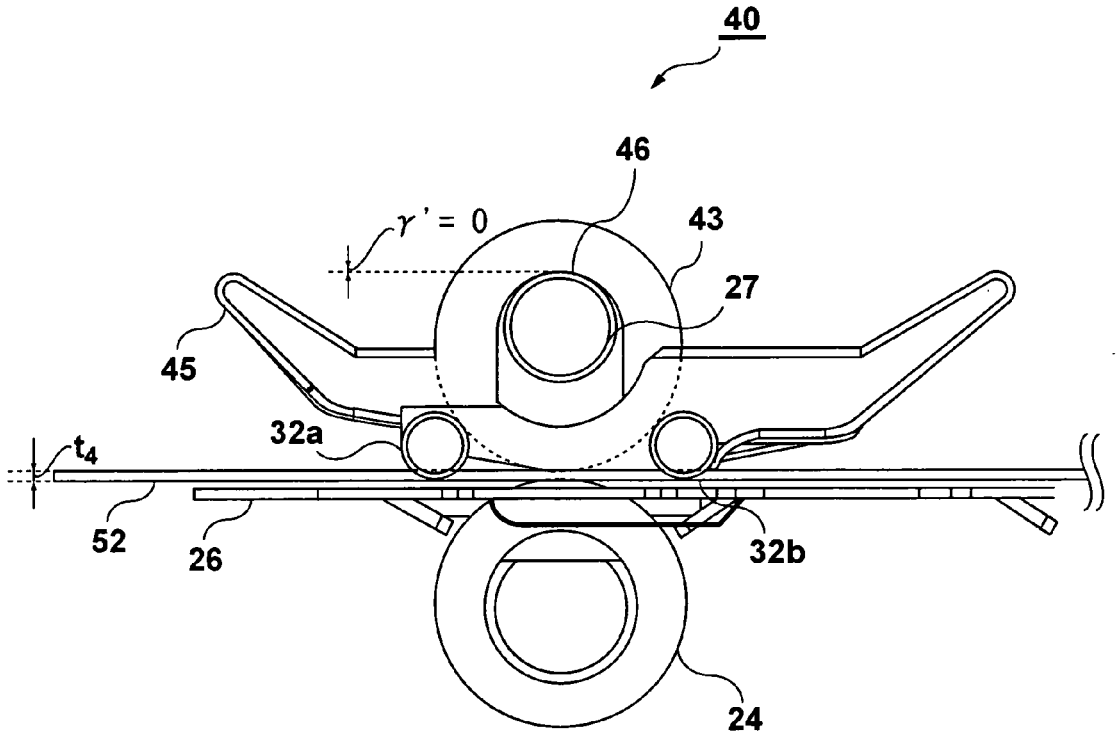
FIG. 17 is a side view for explaining paper conveyance operation of a paper conveying device in embodiment 2 of the invention (II).

Next, regarding the case that a paper whose thickness is thicker than the clearance "γ" between the stopper member 46 and the upper paper feeding roller 43 is conveyed, it is explained through using FIG. 17.

FIG. 17 is a side view for explaining paper conveyance operation of a paper conveying device in embodiment 2 of the invention (II).

The lower paper feeding roller 24 begins to rotate and a paper 52 (FIG. 17) whose thickness is $t_4$ is drawn into sheet guide. Here, $t_4\geqq\gamma$.

When the front end of the paper 52 reaches between the upper paper feeding roller 43 and the lower paper feeding roller 24, the shaft 27 of the upper paper feeding roller 43 is pushed up only by the thickness $t_4$ of the paper 52. Here, because $t_4\geqq\gamma$, the shaft 27 contacts with the stopper member 46 and the stopper member 46 is pushed up by the shaft 27 and rises only by $(t_4-\gamma)$. Together with the rise, the upper sheet guide 45 also moves that is, rises only by $(t_4-\gamma)$ along a direction separating from the lower sheet guide 26.

With the upper paper feeding roller 43 is pushed up and the upper sheet guide 45 rises, the protrusion amount "σ'" of the upper paper feeding roller 43 becomes $\sigma'=(\sigma-t_4)+(t_4-\gamma)=\sigma-\gamma$. Here, $\sigma'>0$, because $\sigma>\gamma$. Therefore, the surface of the roller parts 28 of the upper paper feeding 43 protrudes toward the lower sheet guide 26 from the bottom of the upper sheet guide 45 and the paper 52 is conveyed into sheet guide without contact with the bottom of the upper sheet guide 45.

The paper 52 is conveyed to a printing section with the rotation of the lower paper feeding roller 24. And then, after the lower paper feeding roller 24 is stopped to rotating, the paper conveyance process in the paper conveying device 40 ends.

As mentioned above, while the paper 52 whose thickness is thicker than the clearance "γ" between the upper paper feeding roller 43 and the stopper member 46 is conveyed by the upper paper feeding roller 43 and the lower paper feeding roller 24, the upper sheet guide 45, with the shaft 27 is pushed up, is pushed up along the direction separating from the lower sheet guide 26, that is, the direction separating from the paper conveyance path. By the pushing up operation, the protrusion amount of the upper paper feeding roller 43 from the upper sheet guide 45 is held at a certain amount $(\sigma-\gamma)$ without depending upon the thickness $t_4$ of the paper 52. Therefore, the paper 52 is conveyed into sheet guide without contacting with the bottom of the upper sheet guide 45.

As mentioned above, the paper conveying device 40 of this embodiment, through the stopper member 46 that limits a movement of the upper sheet guide 45 along a direction separating from the upper paper feeding roller 43 is furnished, in the case that thick paper is conveyed via upper paper feeding roller 43 and lower paper feeding roller 24, a certain clearance is formed between the paper and the upper sheet guide 45. By this, when the paper is conveyed via upper paper feeding roller 43 and lower paper feeding roller 24, it is possible to prevent the paper from contacting with the upper sheet guide 45, so in the case that copying serial continuous bill is conveyed as paper, it is possible to inhibit an inter-layer deviation. Therefore, a better smooth paper conveyance is realized.

The present invention is not limited to the foregoing embodiment or example but many modifications and variations are possible within the spirit and scope of the appended claims of the invention.

What is claimed is:

1. A medium conveying device, comprising:

a lower guide for conveying a medium along a conveyance path and supporting the medium by contacting a surface thereof;

a medium guide disposed facing the lower guide, and having two first swing supporting portions and two second swing supporting portions respectively disposed on first and second sides of the conveyance path and outside a region through which the medium is conveyed, the swing supporting portions being in contact with the lower guide when the medium is not conveyed by the lower guide; and a limiting member disposed between the two first swing supporting portions, and between the two second swing supporting portions, to allow the medium guide to swing in a separation direction substantially perpendicular to the lower guide and along a rotation axis coaxial with an axis of the first or second swing supporting portions, according to a thickness of the medium when the medium is in contact with the medium guide.

2. The medium conveying device according to claim 1, wherein the medium guide swings along the separation direction according to a thickness of the medium.

3. The medium conveying device according to claim 1, further comprising:

a pressing member that provides a pressure to the medium guide toward the lower guide.

4. The medium conveying device according to claim 1, wherein the medium guide includes an interval keeping member for keeping a predetermined minimum interval between the medium guide and the lower guide.

5. The medium conveying device according to claim 1, wherein the first and second swing supporting portions keep a predetermined minimum interval between the medium guide and the lower guide.

6. The medium conveying device according to claim 1, wherein the medium guide is located adjacent to a conveying section for conveying the medium.

7. The medium conveying device according to claim 6, wherein the medium guide includes a contacting portion that contacts the conveying section when the conveying section moves the medium a predetermined amount along the separation direction.

8. The medium conveying device according to claim 1, wherein the limiting member includes a protrusion portion that limits movements in a conveyance direction of the medium of a conveying section for conveying the medium.

9. The medium conveying device according to claim 8, wherein the conveying section is a conveying roller.

10. The medium conveying device according to claim 1, wherein the limiting member includes a hole, and a supporting section protruding from the limiting member along an edge of the hole.

11. The medium conveying device according to claim 10, further comprising a conveying section that includes a shaft disposed through the hole.

12. The medium conveying device according to claim 1, further comprising a the conveying section disposed between the first and second swing supporting portions.

13. The medium conveying device of claim 1, wherein the first and second swing supporting portions are of a cylinder shape, the circumferential surface thereof being in contact with the lower guide when the medium is not conveyed by the lower guide.

14. A medium conveying device, comprising:

a lower guide for conveying a medium along a conveyance path and supporting the medium by contacting a surface thereof;

a medium guide disposed facing the lower guide, the medium guide having a first end, a second end opposite to the first end, and two first swing supporting portions and two second swing supporting portions respectively disposed on first and second sides of the conveyance path and outside a region through which the medium is conveyed;

a limiting member disposed between the two first swing supporting portions, and between the two second swing supporting portions, to allow the medium guide to move in a separation direction substantially perpendicular to the lower guide and to swing along a rotation axis coaxial with an axis of the first or second swing supporting portions; and a conveying section disposed adjacent to the medium guide, wherein, when the medium is conveyed from the first end of the medium guide by the conveying section, the first end of the medium guide is pushed upward and away from the lower guide by the medium, and when the medium is conveyed to a predetermined position along the medium guide from the first end of the medium guide by the conveying section, the second end of the medium guide is pushed upward and away from the lower guide by the medium, according to a thickness of the medium when the medium is in contact with the medium guide.

15. The medium conveying device according to claim 14, further comprising:

a pressing member that provides a pressure to the medium guide toward the lower guide.

16. The medium conveying device according to claim 14, wherein the medium guide includes an interval keeping member for keeping a predetermined minimum interval between the medium guide and the lower guide.

17. The medium conveying device according to claim 14, wherein the first and second swing supporting portions keep a predetermined minimum interval between the medium guide and the lower guide.

18. The medium conveying device according to claim 14, wherein the medium guide is located adjacent to the conveying section for conveying the medium.

19. The medium conveying device according to claim 18, wherein the medium guide includes a contacting portion that contacts the conveying section when the conveying section moves a predetermined amount along a separation direction substantially perpendicular to the lower guide.

20. The medium conveying device according to claim 14, wherein the limiting member includes a protrusion portion that limits movements of the medium in a conveyance direction of the conveying section for conveying the medium.

21. The medium conveying device according to claim 20, wherein the conveying section is a conveying roller.

22. The medium conveying device of claim 14, wherein the first and second swing supporting portions are of a cylinder shape, the circumferential surface thereof being in contact with the lower guide when the medium is not conveyed by the lower guide.

23. An image forming apparatus, comprising:

a medium conveying device, including:

a lower guide for conveying a medium along a conveyance path and supporting the medium by contacting a surface thereof;

a medium guide disposed on the lower guide, the medium guide having a first end, a second end opposite to the first end, and two first swing supporting portions and two second swing supporting portions respectively disposed on first and second sides of the conveyance path and outside a region through which the medium is conveyed;

a limiting member disposed between the two first swing supporting portions, and between the two second swing supporting portions, to allow the medium guide to move in a separation direction substantially perpendicular to the lower guide and to swing along a rotation axis coaxial with an axis of the first or second swing supporting portions; and a conveying section disposed adjacent to the medium guide, wherein, when the medium is conveyed from the first end of the medium guide by the conveying section, the first end of the medium guide is pushed upward and away from the lower guide by the medium, and when the medium is conveyed to a predetermined position along the medium guide from the first end of the medium guide by the conveying section, the second end of the medium guide is pushed upward and away from the lower guide by the medium, according to a thickness of the medium when the medium is in contact with the medium guide.

24. The medium conveying device according to claim 23, wherein the medium conveying device further includes a pressing member that provides a pressure to the medium guide toward the lower guide.

25. The medium conveying device according to claim 23, wherein the first and second swing supporting portions keep a predetermined minimum interval between the medium guide and the lower guide.

* * * * *